US008833588B2

(12) United States Patent
Spahmann et al.

(10) Patent No.: US 8,833,588 B2
(45) Date of Patent: Sep. 16, 2014

(54) CONTAINER WITH HANDS-FREE LATCH AND LINKAGE ACTIVATION FOR ACCESS

(71) Applicant: Haul-All Equipment Ltd., Alberta (CA)

(72) Inventors: Peter Spahmann, Alberta (CA); C. Kelly Phillip, Alberta (CA); John Jansen, British Columbia (CA)

(73) Assignee: Haul-All Equipment Ltd., Alberta (CA)

( * ) Notice: Subject to any disclaimer, the term of this patent is extended or adjusted under 35 U.S.C. 154(b) by 0 days.

(21) Appl. No.: 13/753,848

(22) Filed: Jan. 30, 2013

(65) Prior Publication Data

US 2014/0209605 A1 Jul. 31, 2014

(30) Foreign Application Priority Data

Jan. 29, 2013 (CA) ..... 2804082

(51) Int. Cl.
*B65D 43/26* (2006.01)
*B65D 55/00* (2006.01)

(52) U.S. Cl.
CPC ..... *B65D 55/00* (2013.01); *Y10S 220/908* (2013.01)
USPC ..... 220/264; 220/260; 220/262; 220/263; 220/730; 220/908

(58) Field of Classification Search
CPC .... B65D 43/26; B65D 43/262; B65D 43/267; B65F 1/1623; B65F 1/163; B65F 1/1646
USPC ..... 220/260, 262, 263, 264, 730, 908, 220/908.2, 908.3
See application file for complete search history.

(56) References Cited

U.S. PATENT DOCUMENTS

| | | | | |
|---|---|---|---|---|
| 5,531,348 | A * | 7/1996 | Baker et al. | 220/264 |
| 7,374,060 | B2 * | 5/2008 | Yang et al. | 220/263 |
| 8,136,179 | B2 | 3/2012 | Li et al. | |
| 8,266,730 | B2 | 9/2012 | Ricca | |
| 8,308,228 | B2 | 11/2012 | Lawson et al. | |

FOREIGN PATENT DOCUMENTS

| | | | |
|---|---|---|---|
| CN | 102502135 | A | 6/2012 |
| CN | 202295983 | U | 7/2012 |
| DE | 29902385 | U1 | 6/1999 |

* cited by examiner

*Primary Examiner* — Fenn Mathew
*Assistant Examiner* — Madison L Poos
(74) *Attorney, Agent, or Firm* — Dinsmore & Shohl LLP

(57) ABSTRACT

The invention pertains to a foot operated latch and linkage means permitting hands-free access to a waste or recycling container. The latch includes a kick plate which is interlocked with a foot pedal whereby displacement of the kick plate permits release of the foot pedal to move from a latched position to an unlatched position, which pedal movement engages a linkage which opens a user access door in the container.

14 Claims, 13 Drawing Sheets

CONTAINER WITH HANDS-FREE LATCH AND LINKAGE ACTIVATION FOR ACCESS

CROSS-REFERENCE TO RELATED APPLICATIONS

This application claims the benefit of Canadian Application No. 2,804,082 filed Jan. 29, 2013 and entitled CONTAINER FOR HANDS-FREE LATCH AND LINKAGE ACTIVATION FOR ACCESS. The entire contents of said application is hereby incorporated by reference.

BACKGROUND OF THE INVENTION

The present invention relates to containers, and particularly refuse or recycling containers, which are resistant to animal access. The containers include a foot-activated latch and linkage which permits hands-free activation of a user access door and related chute opening into the container. Such containers have particular application in recreational areas where large animals, such as bears, endeavour to access any refuse within the container. Consequently, the basic structure is rugged, and able to withstand animal abuse while substantially eliminating access to the contents of the container.

Refuse or recycling containers often attract attention of animals, and consequently containers used in areas where wildlife is present must be able to withstand attempts by animals to gain access to refuse or other materials contained within the container. Various attempts to limit or prevent animal access have been employed, including weights, locks and concealed latches. However, such devices have also posed additional difficulties for users of the containers, inevitably requiring exact handling and manipulation by users.

One successful animal resistant container, manufactured by the Applicant herein under the trade-mark HID-A-BAG includes a latched hinged lid. The latch is recessed under a covering on the lid, and must be raised beneath the covering in order to release the lid. This requires a user to rotate his/her hand, palm upwards, to raise the latch within the enclosure. Many animals, particularly including bears, do not have a rotatable wrist and cannot operate such a latch. Nonetheless, such device requires manual manipulation by a user.

Many other latches, either hand or foot operated, involve a simple release movement such as depressing a lever pedal or push rod. The present invention is an interlocked foot-operated latch and linkage which opens a user access door, thereby leaving a user's hands free for access to the container. While foot-operated pedals and linkages are known to open container lids, such as a common kitchen waste basket, such devices are also operable by any downward pressure as may be exerted by an animal. The present invention provides a latch with an interlocked foot pedal, which inhibits simple downward pressure as may be exerted by an animal, thereby substantially preventing operation by an animal such as a bear.

The present invention provides a hands-free, foot-operable latch and linkage to open a container access door for a user, which is self-latching upon release of the foot pedal.

Further, the hands-free access for deposit of material into the container avoids manual contact with the container or user access door, thereby avoiding potential contamination of a user's hands from surfaces which may harbour bacteria or germs.

DETAILED DESCRIPTION OF THE INVENTION

Figure 1:
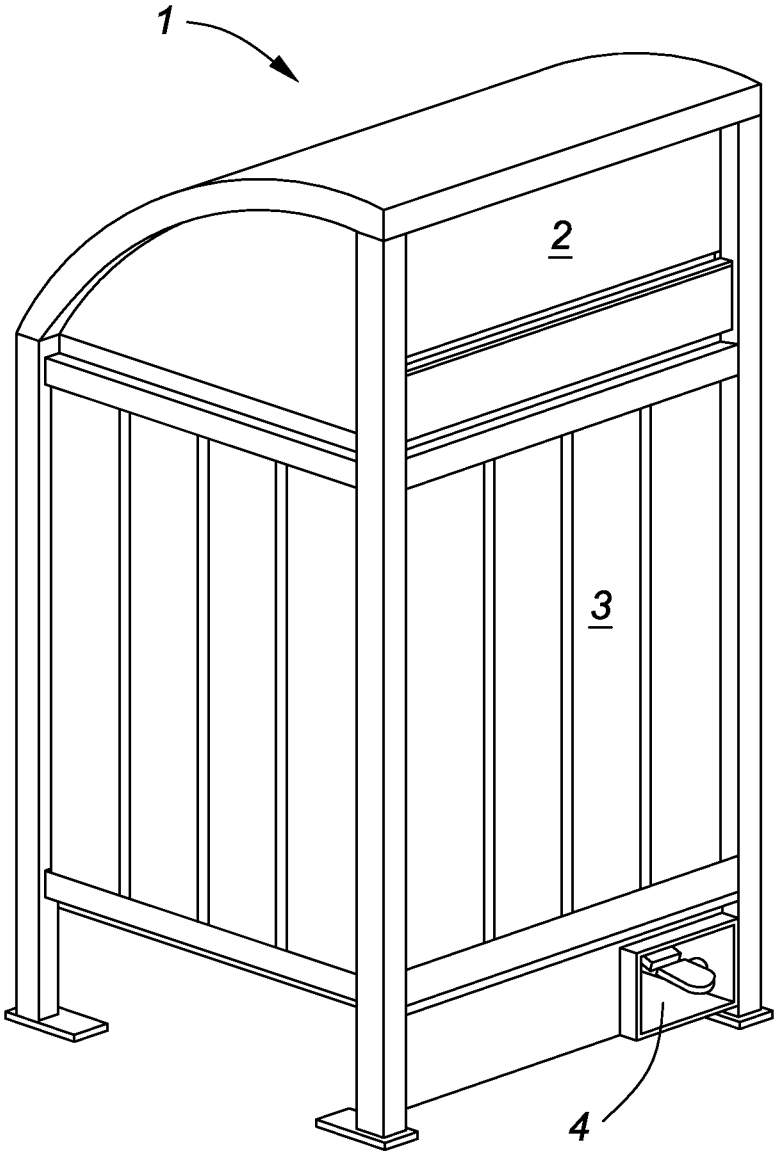
FIG. 1 is a perspective view of a container, embodying the latching system of the present invention, in a closed condition.
Figure 2:
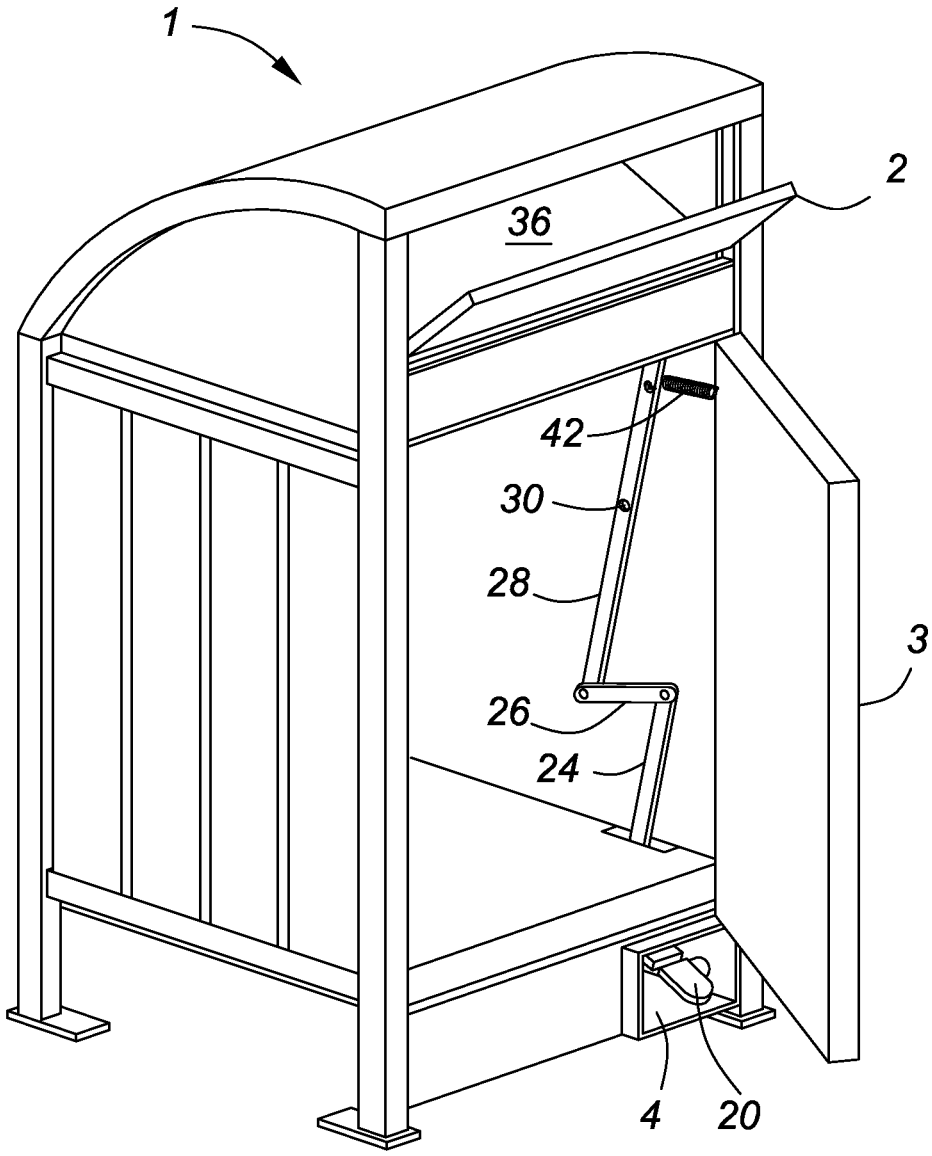
FIG. 2 is a perspective view of a container, embodying the latching system of the present invention, in a user access door in an open position, and the main service door open to illustrate the interior linkage.
Figure 3:
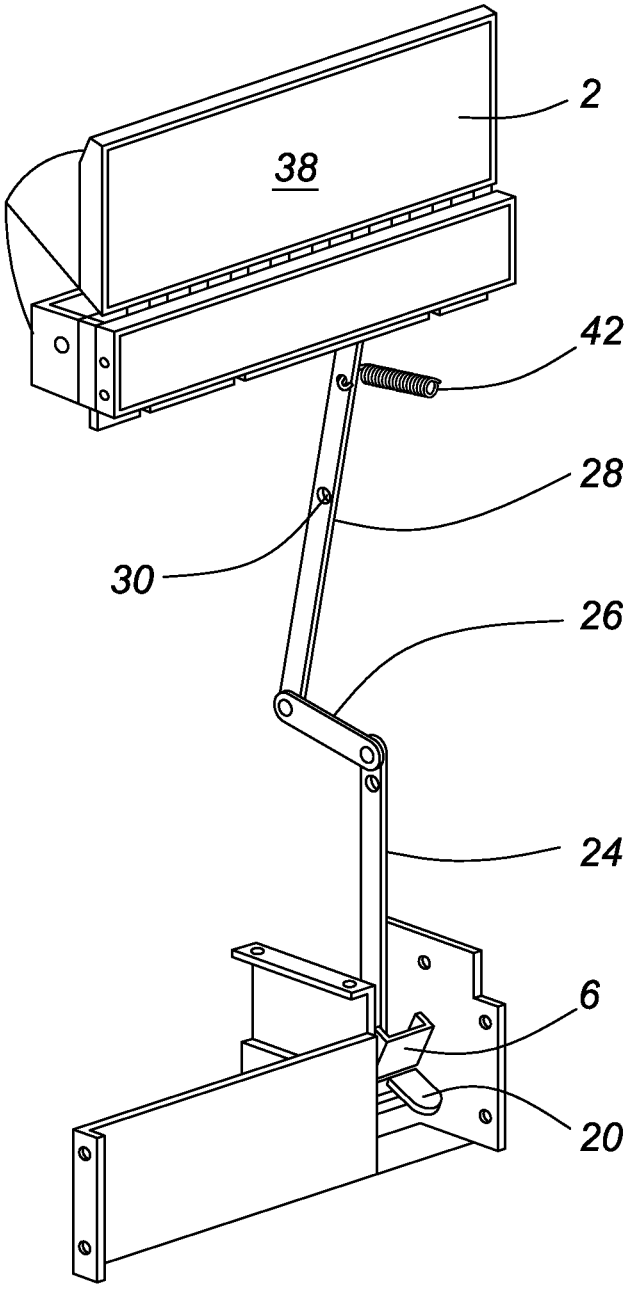
FIG. 3 is a schematic view of the linkage with the user access door closed.
Figure 4:
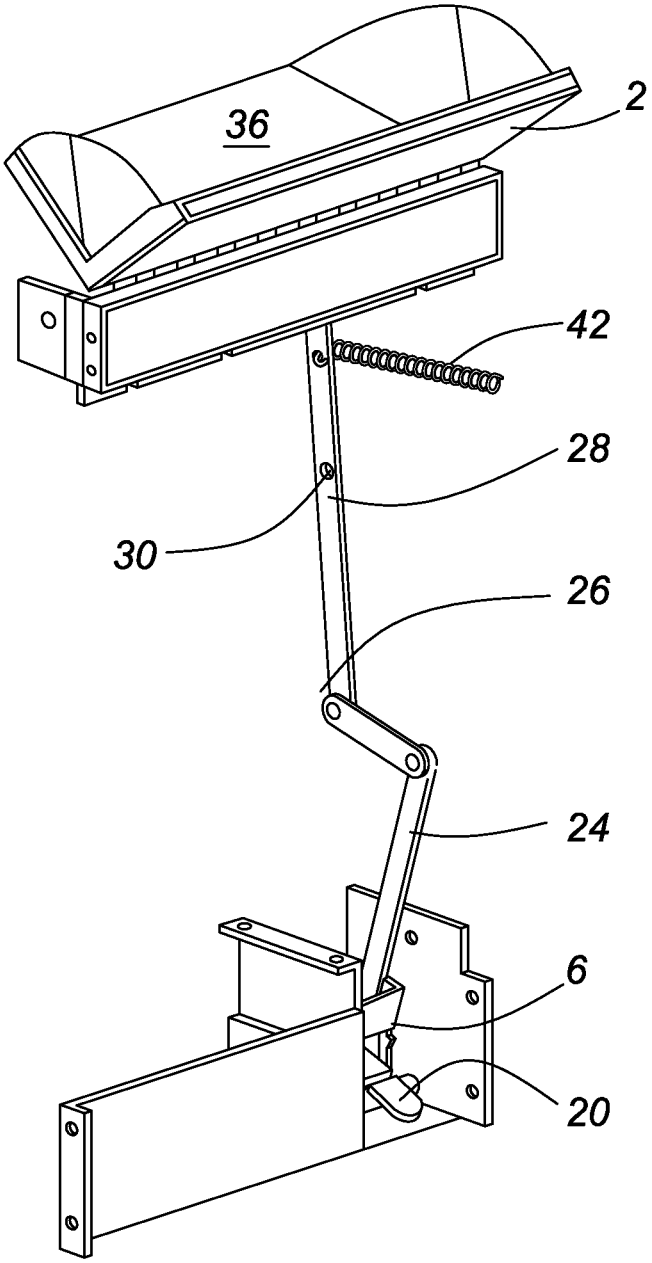
FIG. 4 is a schematic view of the linkage with the user access door open.

As may be seen from FIGS. 1 and 2, a refuse or recyclables container 1 is illustrated. The container has a user access door 2, which rotates outwardly under operation of the latch and linkage of the present invention. A service door 3 may be opened to gain access to the enclosed storage compartment to permit placing and removal of a refuse/recyclables storage bag contained on a frame (not shown) or similar bin within the container. A separate latch (not shown) retains service door 3 in a closed position.

A latch recess 4 contains the activating mechanism for the linkage. As may be seen in FIG. 5, the latch activating mechanism includes a kick plate or bumper 6, which is connected to a pair of support arms 8 affixed to pivot rod 10. A spring retainer 12 mounted across support arms 8 rests against a torsion spring 14, which biases the arms 8 and kick plate 6 towards the front of the container. From the aforesaid arrangement, as may be seen in FIGS. 7 and 8, kick plate 6 may be rotated rearwardly in the direction of arrows 'A' against the action of torsion spring 14. Support arms 8 include a step lock 16, which extends forwardly to support a pedal locking pin 18, mounted on the underside of foot pedal 20. A foot pedal 20 extends rearwardly into recess 4 and is attached to a pedal pivot 22. A linkage actuating lever 24 extends vertically from the rear portion of foot pedal 20 at the pedal pivot 22. As may be seen from FIG. 8, when kick plate 6 is pushed rearwardly by the toe of a user, pedal step lock 16 is disengaged from under pedal locking pin 18, permitting foot pedal 20 to be depressed. As may again be seen in FIGS. 5, 7 and 8, depression of foot pedal 20 allows it to rotate about pedal pivot 22, causing the upper end of actuating lever 24 to move accurately forward within the confines of the container.

Figure 6:
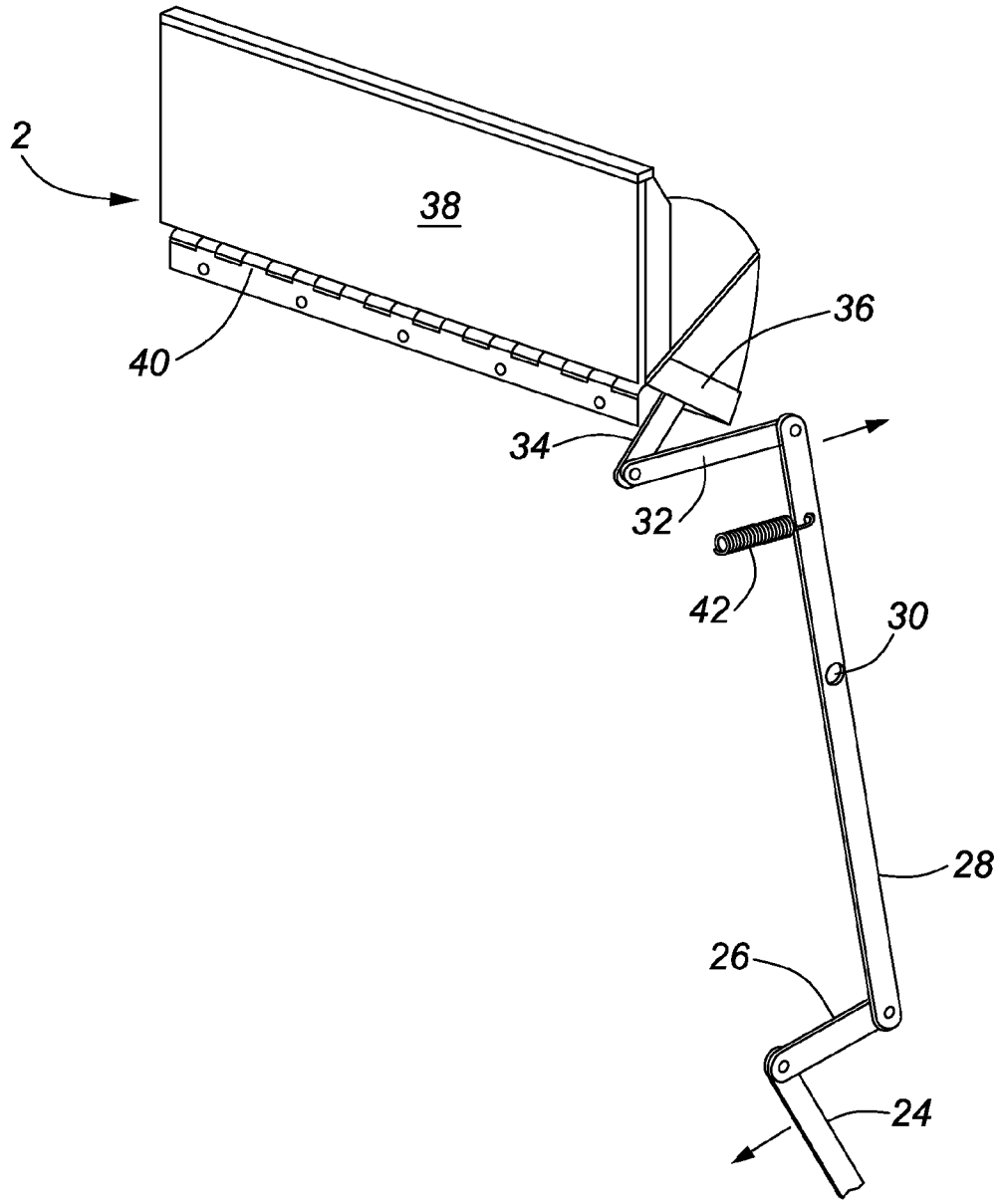
FIG. 6 is a schematic view of the upper linkage.

Referring now to FIG. 6, the upper portion of the access door activation linkage is illustrated. Actuating lever 24 is rotationally connected at its distal end 25 to a generally horizontal lower link 26, which in turn is rotationally connected at 27 to one end of a generally vertical pivoting lever 28, which is pivotable about pivot 30. Pivot 30 is fixed to the adjacent interior side wall of container 1. The other, upper end of pivoting lever 28 is rotationally connected at 31 to a generally horizontal upper link 32. Upper link 32 is pivotally connected at 33 to a bell crank type activating bracket 34, which in turn is rigidly fastened to a rearward flap 36 of access door 2. Front flap 38 of access door 2, in conjunction with rear flap 36 forms a chute permitting refuse to be discharged into the interior of container 1. Door 2, comprising flaps 36 and 38, pivots about a door hinge 40 which joins the door 2 to the container structure. Flaps 36 and 38 are oriented at an angle of approximately 120 degrees in one embodiment of the invention but the angle may vary depending on the usage.

A spring 42 connects above pivot 30 to pivoting lever 28 at one end, and at the other end 43 is connected to a forward portion of the adjacent side wall of container 1 to bias the upper end of pivoting lever 28 forwardly to normally maintain the access door 2 in a closed position. Alternatively a biasing spring may be connected below pivot 30, operating in the opposite direction. Still further, both an upper spring 42 and a lower spring could be utilized for greater biasing force.

Figure 5:
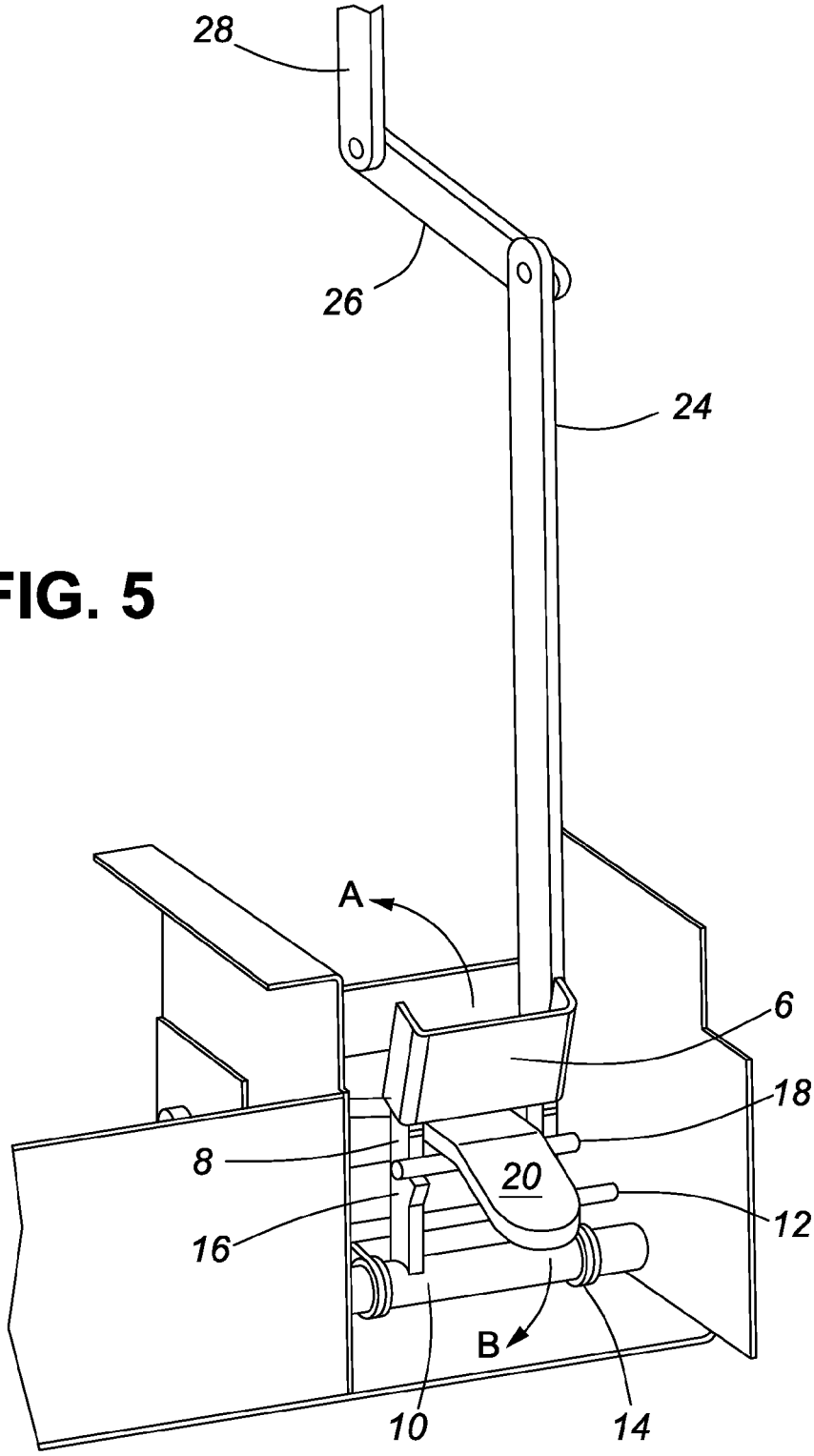
FIG. 5 is a detail of the lower latch linkage.
Figure 7:
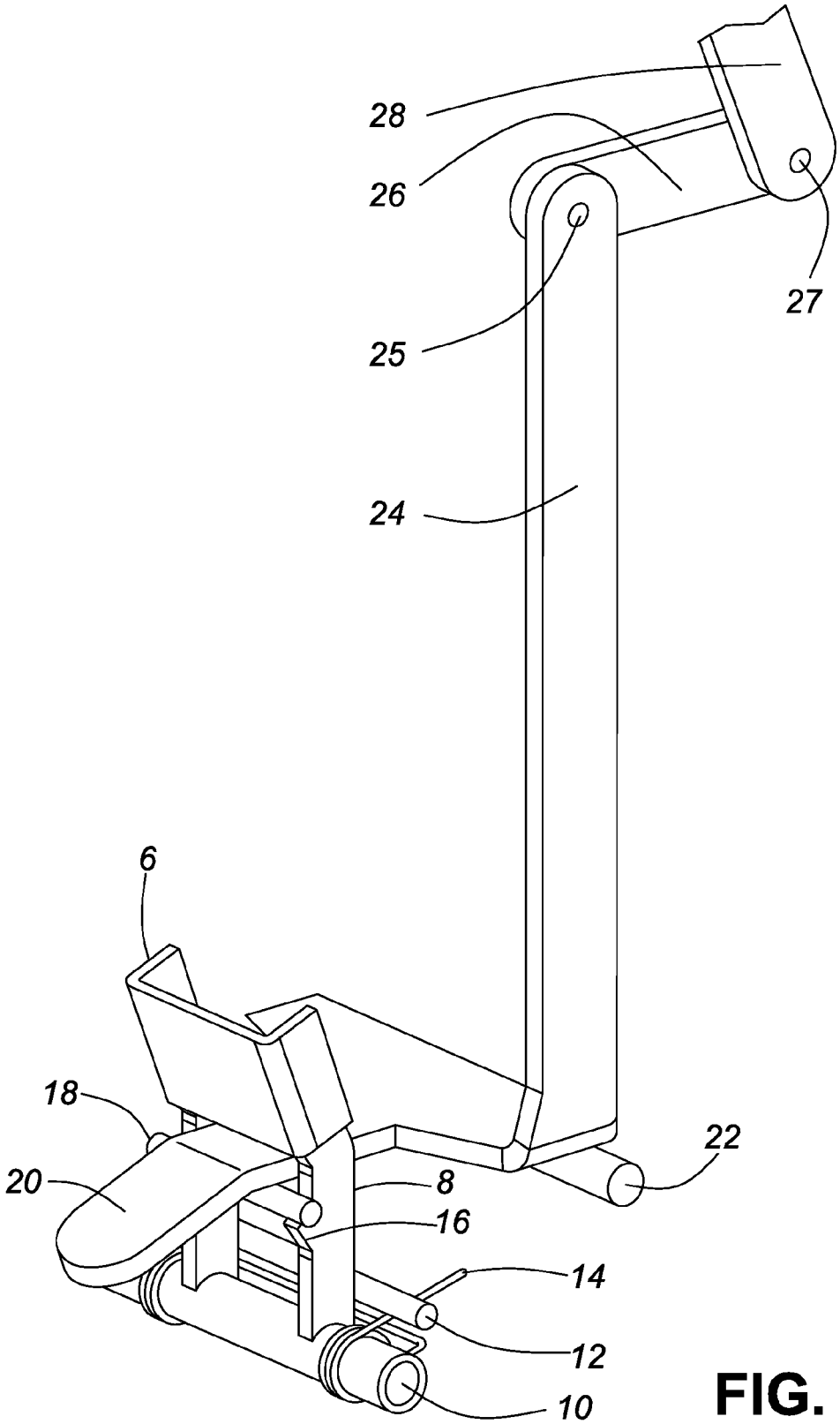
FIG. 7 is a schematic view of the foot pedal in latched position.
Figure 8:
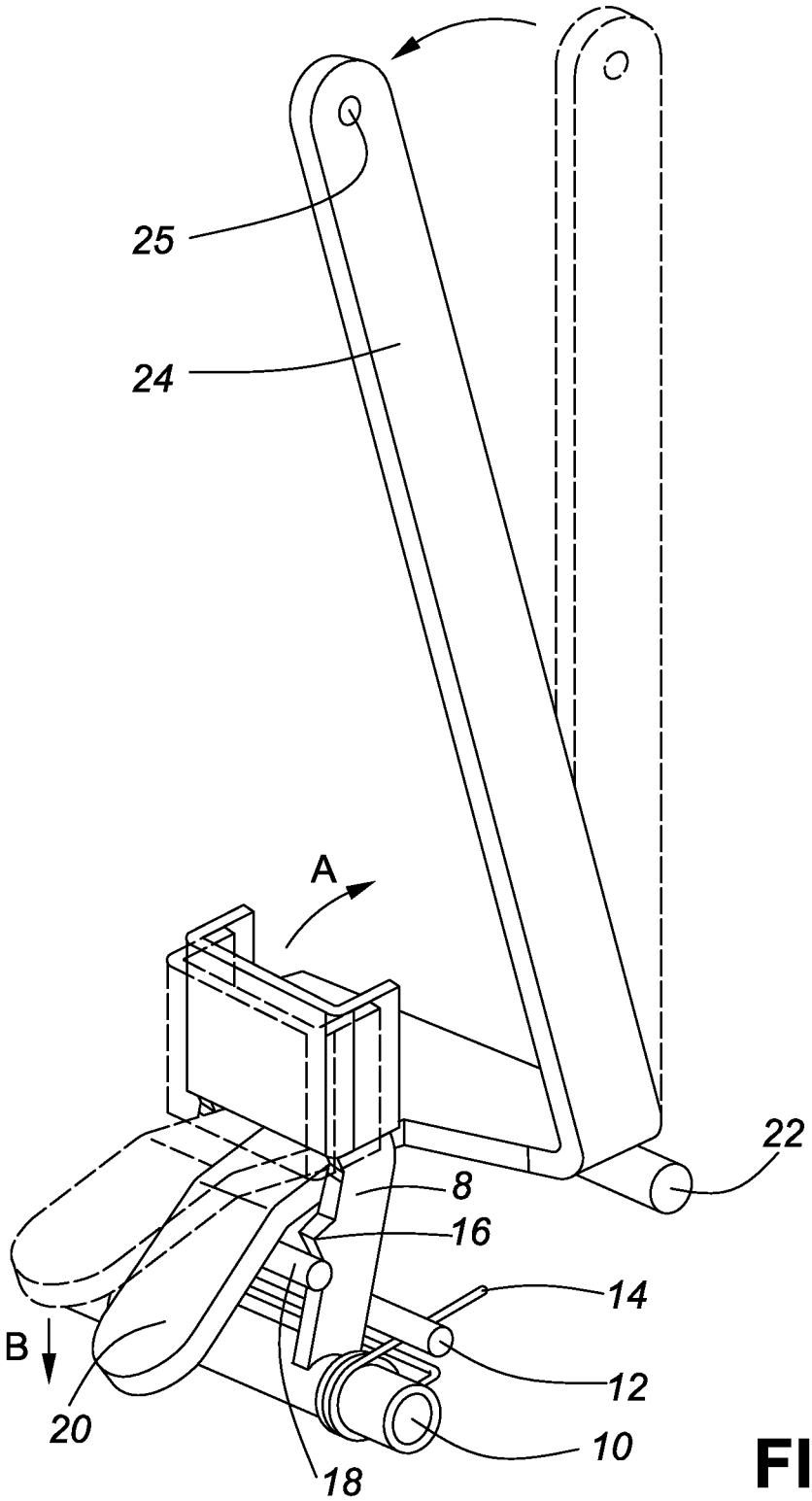
FIG. 8 is a schematic view of the foot pedal in operated position.
Figure 9:
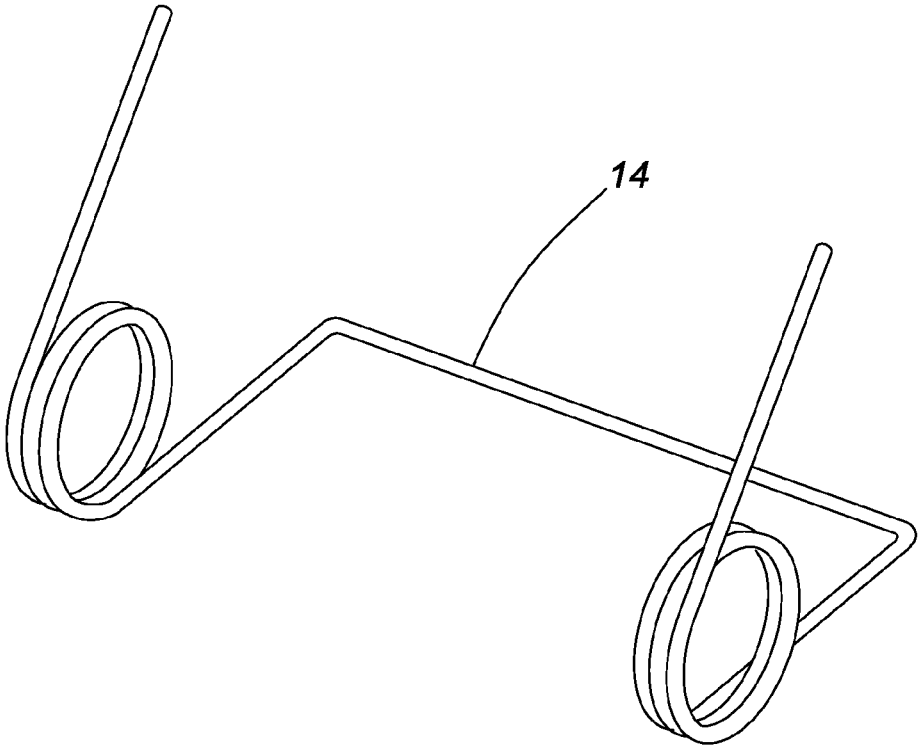
FIG. 9 illustrates a latch spring.
Figure 10:
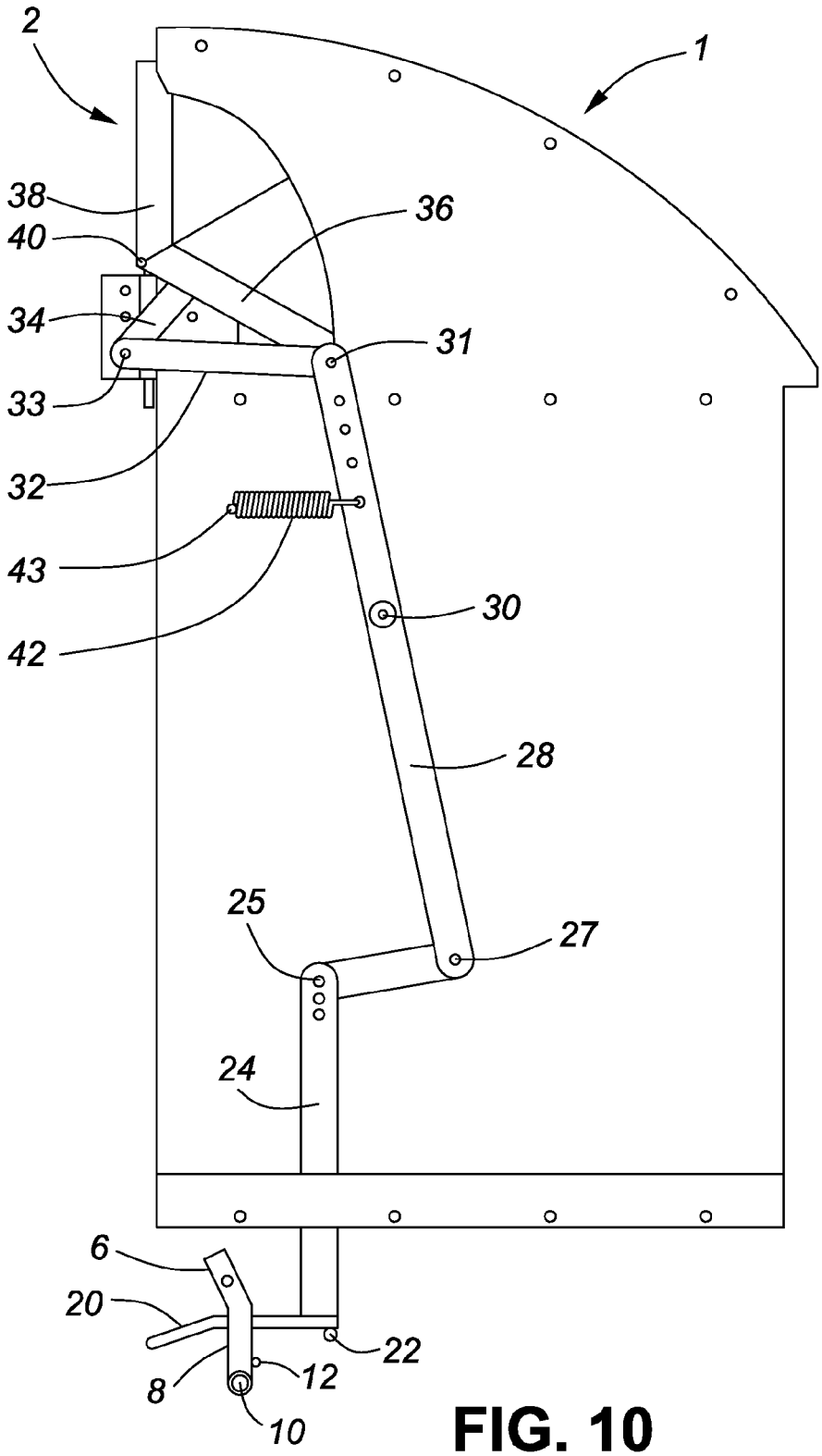
FIG. 10 is a side elevation view of the latch and linkage in a closed position of the access door.
Figure 11:
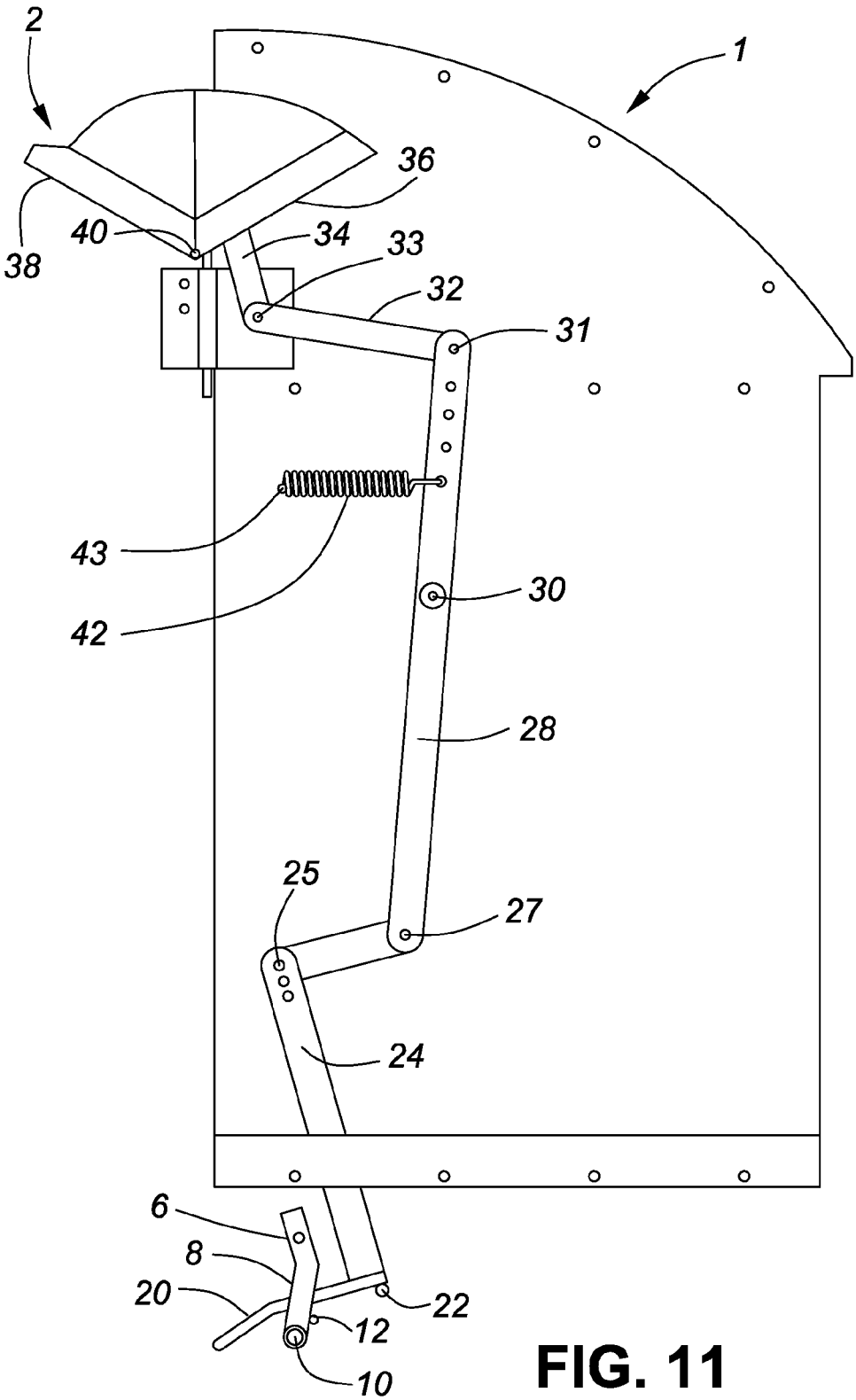
FIG. 11 is a side elevation view of the latch and linkage in an open position of the access door.
Figure 12:
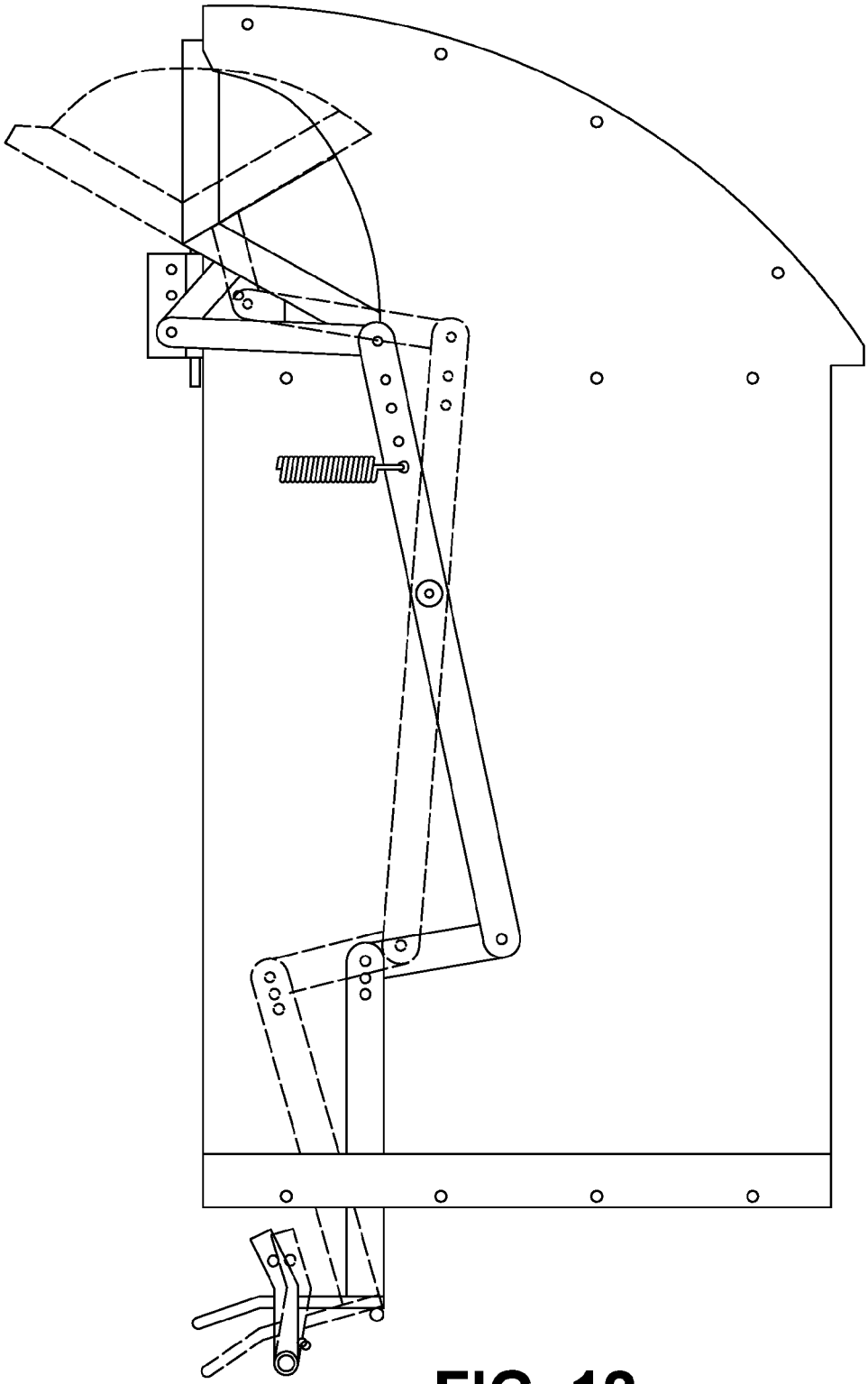
FIG. 12 is an overlay of the latch and linkage in the closed and open positions of FIGS. 10 and 11.

As may be seen from FIGS. 5, 7 and 8, in operation of the latch and linkage for hands-free access to the container, a user first manipulates the kick plate 6, and rotating arms 8 rearwardly about pivot rod 10 in the direction of arrow A against the bias of torsion spring 14, thereby disengaging pedal step lock 16 and permitting foot pedal 20 to be depressed. As previously noted, depression of foot pedal 20 allows it to rotate in the direction of arrow B about pedal pivot 22, causing the upper end of actuating lever 24 to be moved forwardly. Referring now to FIGS. 6, 10 to 12, when the upper end of actuating lever 24 is moved forwardly, lower link 26, connected to the lower end of pivoting lever 28, moves that end of the lever 28 forwardly. Forward motion of the lower end of lever 28 pivots the lever about pivot 30 and moves the upper end of lever 28 rearwardly against the bias of spring 42. The upper end of pivoting lever 28 is connected at 31 to upper link 32, which is connected to and draws the activating bracket 34 rearwardly causing access door 2 to pivot into an open position about door hinge 40. A user may then insert refuse into the chute area, defined by flaps 36 and 38.

Release of the user's foot from pedal 20 allows biasing return spring 42 to draw the upper end of pivoting lever 28 forwardly, thereby closing access door 2. The linkage moves to draw actuating lever 24 rearwardly, pivoting foot pedal 20 into the starting latched position. At the same time, torsion spring 14 returns support arms 8 and kick plate 6 to the start position, with pedal step lock 16 re-engaging pedal locking pin 18 to prevent opening of user door 2.

The novel combination of interlocked kick plate 6 and foot pedal 20 establishes a lock or latch which prevents operation of the linkage and activation of the user access door until properly sequentially activated. Such interlock inhibits operation by animals, particularly bears. Furthermore, the constraining size or aperture of latch recess 4 prevents access by a wide foot, such as that of a bear, further inhibiting animal activation of the latch and linkage.

Figure 13:
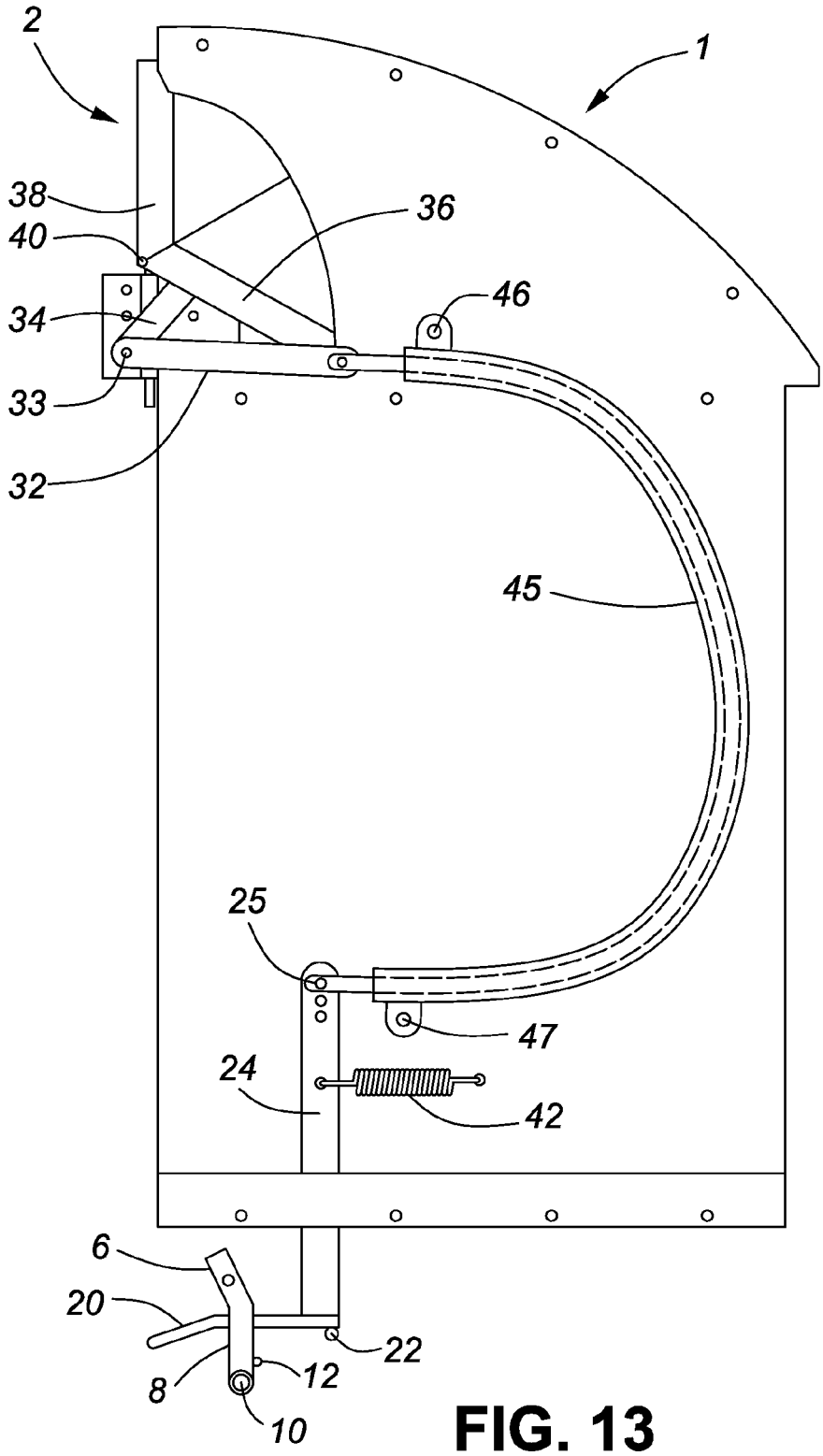
FIG. 13 is a side elevation view of FIG. 11 with the intermediate linkage replaced by a Bowden cable.

While the basic latch and linkage mechanism of embodiments of the invention have been set out above, it will be appreciated that the precise form of latching elements may be varied, while still maintaining the principle of interlocked kick plate and foot pedal before the linkage may be actuated to propel the user access door into an open position for hands-free access. For example, the kick plate may be positioned on a biased slider, rather than pivot. The linkage above the actuating lever may be replaced by a direct connection to the actuating bracket or the linkage may be provided by a Bowden cable 45 as shown in FIG. 13. The ends of the Bowden cable are fixed at anchors 46 and 47.

A container embodying such a linkage may include a shield plate inside the container to prevent interference between bagged refuse and the access door linkage. As well, the front service door may be latched in any preferred form, or may employ a full hasp and lock.

While preferred embodiments of the invention have been illustrated, variations as would be understood by a person skilled in the art may be employed and are included within the scope of the invention as the appended claims are purposively construed.

The invention claimed is:

1. A foot-operated latch means for hands-free access to a container comprising an interlocking latch having a kick plate with a step lock, and a foot pedal with a locking pin, each of the kick plate and foot pedal having a first latched position and a second unlatched position whereby, in the latched position, the locking pin is constrained by the step lock to prevent movement of the foot pedal from the latched position until the kick plate is first moved from the latched position to the unlatched position;

the latch means further comprising linkage operatively connected between the foot pedal and a hinged access door, whereby movement of the foot pedal from the first latched position to the second unlatched position causes the linkage to crank, via an actuating bracket, the hinged access door to an open position.

2. The latch means of claim 1, wherein the kick plate is moveable pivotally to the unlatched position, thereby disengaging the lock step from the locking pin to permit movement of the foot pedal.

3. The latch means of claim 2, wherein the foot pedal is moveable about a pivot once the lock step has been moved into its unlatched position.

4. The latch means of claim 2, wherein the foot pedal includes an actuating lever.

5. The latch means of claim 4, where pivotal movement of the foot pedal also provides pivotal movement of the actuating lever.

6. The latch means of claim 1, wherein resilient means biases the kick plate towards the latched position.

7. The latch means of claim 6, wherein the resilient means is a spring.

8. The latch means of claim 7, wherein the spring biasing the kick plate is a torsion spring.

9. The latch means of claim 1, wherein resilient means biases the foot pedal towards the latched position.

10. The latch means of claim 9, wherein the resilient means is a spring.

11. The latch means of claim 10, wherein the spring biasing the foot pedal towards the latched position is an axial spring.

12. The latch means of claim 1, wherein the linkage to the access door comprises an actuating lever fixed at its proximal end to the foot pedal, a pivoting lever, and an activating bracket fixed at its proximal end to the hinged access door of the container, wherein a first link connects a distal end of the actuating lever to one end of the pivoting lever, and wherein a second link connects the other end of the pivoting lever to a distal end of the activating bracket, whereby upon movement of the foot pedal from the latched position to the unlatched position, the distal end of the actuating lever is moved, the one end of the pivoting lever is simultaneously moved by the first link and the other end of the pivoting lever is reciprocated, simultaneously moving the second link connected to said other end of the pivoting lever and the activating bracket, whereby the activating bracket cranks the hinged access door to an open position.

13. The latch means of claim 1, wherein the linkage to the hinged access door comprises an actuating lever fixed at its proximal end to the foot pedal, a Bowden cable extending from the distal end of the actuating lever to one end of an activating bracket, the other end of the activating bracket being fixed to the hinged access door to enable pivotal opening of the door.

14. The latch means of claim 12, wherein the activating bracket is a bell crank.

* * * * *

UNITED STATES PATENT AND TRADEMARK OFFICE

CERTIFICATE OF CORRECTION

PATENT NO. : 8,833,588 B2
APPLICATION NO. : 13/753848
DATED : September 16, 2014
INVENTOR(S) : Peter Spahmann et al.

It is certified that error appears in the above-identified patent and that said Letters Patent is hereby corrected as shown below:

On the title page

Item (72) "Inventors: Peter Spahmann, Alberta (CA);
Kelly Phillip, Alberta (CA);
John Jansen, British Columbia (CA)"

should read

Item (72) --Inventors: Peter Spahmann, Alberta (CA);
Kelly Philipp, Alberta (CA);
John Jansen, British Columbia (CA)--

Signed and Sealed this
Twenty-ninth Day of December, 2015

Michelle K. Lee

Michelle K. Lee
*Director of the United States Patent and Trademark Office*